United States Patent [19]

Muise

[11] 4,369,913

[45] Jan. 25, 1983

[54] TRAY

[75] Inventor: Herbert D. Muise, Orange, Calif.

[73] Assignee: Weyerhaeuser Company, Tacoma, Wash.

[21] Appl. No.: 297,792

[22] Filed: Aug. 31, 1981

[51] Int. Cl.[3] ..... B65D 5/48

[52] U.S. Cl. ..... 229/30; 229/27

[58] Field of Search ..... 229/30, 32, 23 R, 23 A, 229/34, 27, 15

[56] References Cited

U.S. PATENT DOCUMENTS 2,744,675 5/1956 Crane .
2,875,939 3/1959 Crane .
2,903,176 9/1959 Crane ..... 229/27
3,036,753 5/1962 Davis et al. .
3,074,615 1/1963 Johnson .
3,127,086 3/1964 Crane ..... 229/27
3,194,472 7/1965 Crane .

*Primary Examiner*—Herbert F. Ross

[57] ABSTRACT

A tray providing better bottom strength and better stacking strength. The tray has a double-ply base panel which will not bulge to the extent a single-ply tray would. Double-ply lower end panels are attached to the double-ply base panel. These lower end panels in conjunction with the upper end panels, the side end flaps and the interior locking panels provide quintuple-ply end sections which provide better strength.

8 Claims, 8 Drawing Figures

33
67
60
64
30
64
50
61
66
61
53
52
51
57
68
54
69
58
65
32
30
12
51
57
52
54
68
62
69
55
58
56
63
62
52
56
69
58
54
57
51
55
69
53
68
50
64
52
68
61
66
60
12
65
58
54
57
51
67
44
13
30
33
32
12
64
22
34
21
30
35
44
32
72
31

61
62
32
33
62
30
61
44
30
72
21
32
33
13
40
44
30
41
31
43
40
35
32
42
40
43
25
41
40
31
35

TRAY

BACKGROUND OF THE INVENTION

1. Field of the Invention

A tray construction having a double ply base construction and a quintuple-ply end construction to provide better bottom strength and better stacking strength.

2. Description of Other Patents

Crane, U.S. Pat. No. 2,744,675 granted May 8, 1956; Crane, U.S. Pat. No. 2,875,939 granted Mar. 3, 1959; Davis, et al, U.S. Pat. No. 3,036,753 granted May 29, 1972; Johnson, U.S. Pat. No. 3,074,615 granted Jan. 22, 1963; and Crane, U.S. Pat. No. 3,194,472 granted July 13, 1965 are exemplary of patents disclosing tray structures.

SUMMARY OF THE INVENTION

The purpose of the present invention is to provide a tray with better bottom strength and better stacking strength. The tray has a double-ply base panel that will not bulge as a single ply tray would. A pair of double-ply lower end panels are attached to this double-ply base panel. These double-ply lower end panels in conjuction with upper end panels, the side end flaps and interior locking panels provide quintuple-ply end sections which provide greater stacking strength.

DESCRIPTION OF THE PREFERRED EMBODIMENTS

Figure 1:
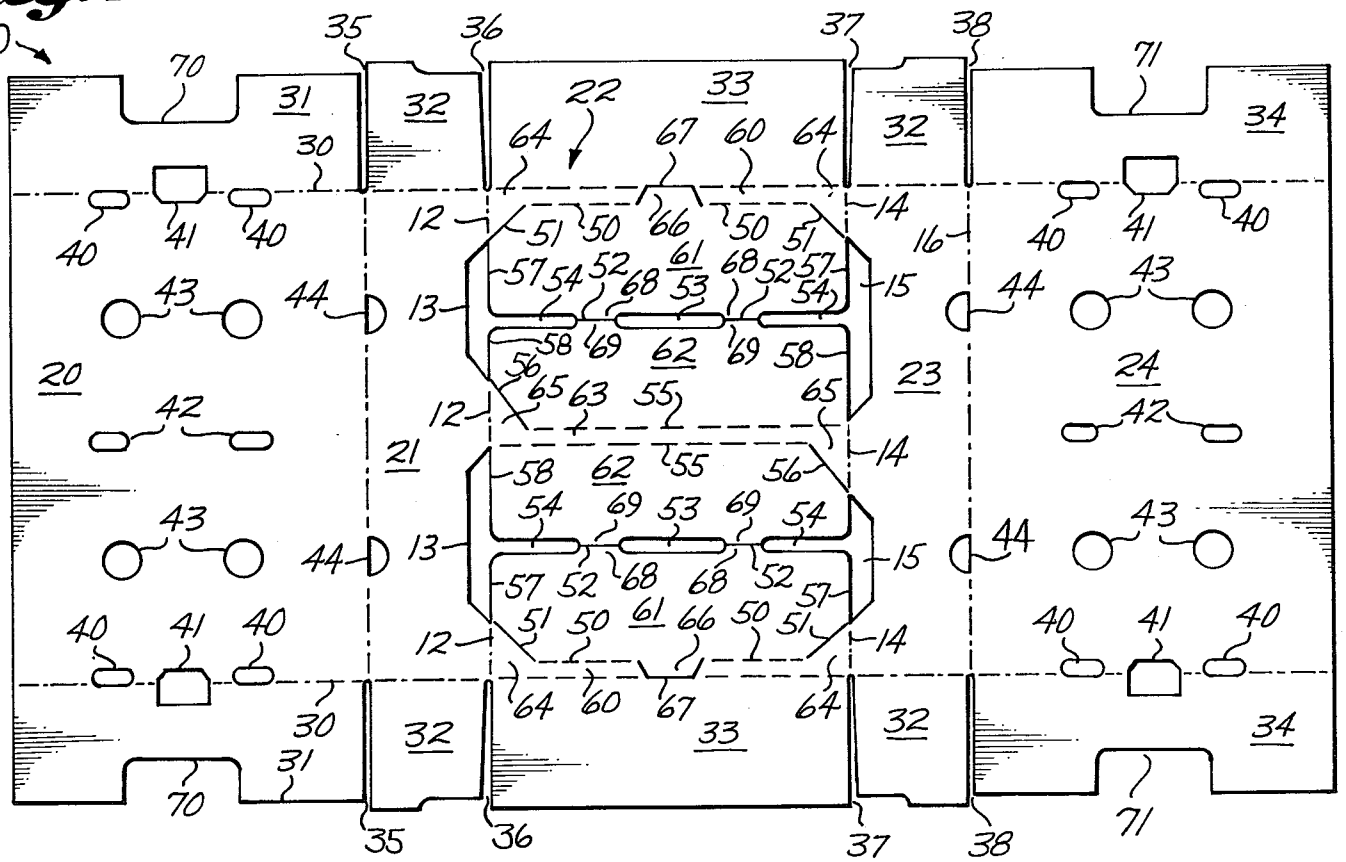
FIG. 1 is a top plan view of the blank for the tray.

The material for the tray is normally double faced corrugated.

The blank 10 is divided by score lines 11, score lines 12 and aligned relief apertures 13, score lines 14 and aligned relief apertures 15 and score line 16 into a first base panel 20, a first side panel 21, an upper section 22, a second side panel 23 and a second base panel 24. These score lines extend in the direction of the corrugations, longitudinally of the blank. A pair of transverse score lines 30 define the ends of the first and second base panels 20 and 24, the first and second side panels 21 and 23 and the upper section 22.

The score lines 30 also act as the hinges for the first lower end panels 31 which are attached to the ends of first base panel 20, the side end flaps 32 which are attached to the ends of side panels 21 and 23, the upper end panels 33 which are attached to the ends of the upper section 22 and the second lower end panels 34 which are attached to the ends of the second base panel 24. The first lower end panels 31, side end flaps 32, upper end panel 33, and second lower end panel 34 are separated from each other by slots 35, 36, 37 and 38. The slots are aligned with score lines 11, 12, 14 and 16, respectively.

There are a number of apertures or holes in each of the base panels. An aperture or hole in one base panel is aligned with the corresponding aperture or hole in the other base panel when the base panels are fastened together. Located along each of the score lines 30 are a pair of exterior locking apertures 40 and a central stacking aperture 41. The locking apertures 40 along one score line are aligned with the locking apertures 40 along the other score line. The stacking apertures 41 are aligned longitudinally to the container also. Located centrally of the base panel are another pair of locking apertures 42. These are also aligned with the locking apertures 40. A number of air holes 43 are also formed in each base panel.

There are also a number of air holes 44 formed in the side panels 21 and 23. They would normally be formed along the lower edge of the side panel.

The upper tray section 22 is divided by outer score lines 50 and their exterior cut lines 51, partition cut lines 52 and their aligned central apertures 53 and exterior apertures 54, and interior score lines 55 and their exterior cut lines 56 into outer upper panels 60, locking panels 61, central partitions 62 and central upper panel 63. Cut lines 51 form ledges 64 in the upper corners of the tray and cuts 56 form ledges 65 centrally of the tray.

The locking panels 61 are hinged to the outer upper panels 60 along score lines 50 and the central partitions 62 are hinged to the central upper panel 63 along score lines 55. Stacking tabs 66 are formed in the upper edge of locking panels 61 by the U-shaped cuts 67 which extend through the outer upper panels 60. Locking tabs 68 and 69 are formed on the lower edges of the locking panels 61 and central partitions 62 respectively by the cut lines 52 and the adjoining apertures 53 and 54. The side edges 57 of locking panels 61 and side edges 58 of central partitions 62 are aligned with the score lines 12 and 14 so that the partitions will extend to the inner faces of the side walls 21 and 23 in the upright container.

The relief apertures 13 and 15 form reliefs in the upper edge of the side walls 21 and 23, respectively.

In forming the tray, the second base panel 24 is adhered to the first base panel 20 to form a laminated double-ply base panel 25 and the second end panels 34 are adhered to the first end panels 31 to form laminated double-ply end panels 35. In the construction shown, the inner faces of first base panel 20 and first end panels 31 are adhered to the outer faces of second base panel 24 and second end panels 34.

The upper ends of end panels 31 and 34 are relieved at 70 and 71, respectively, to form relief section 72 in the laminated end panels 35. The relief section 72 is to accommodate stacking and tying wires which may be inserted into it. The wires are used for tying several trays together or for tying down the lids on the individual trays. This relief section is optional and need not be included in the tray.

Figure 2:
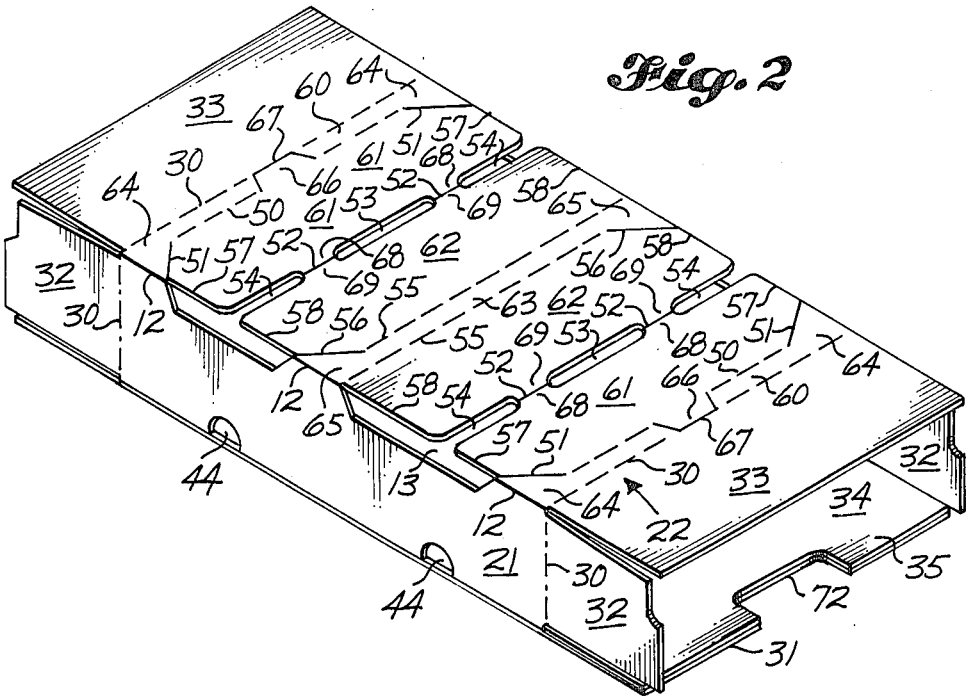
FIG. 2 is an isometric view of the upright tray seen from the top.
Figure 3:
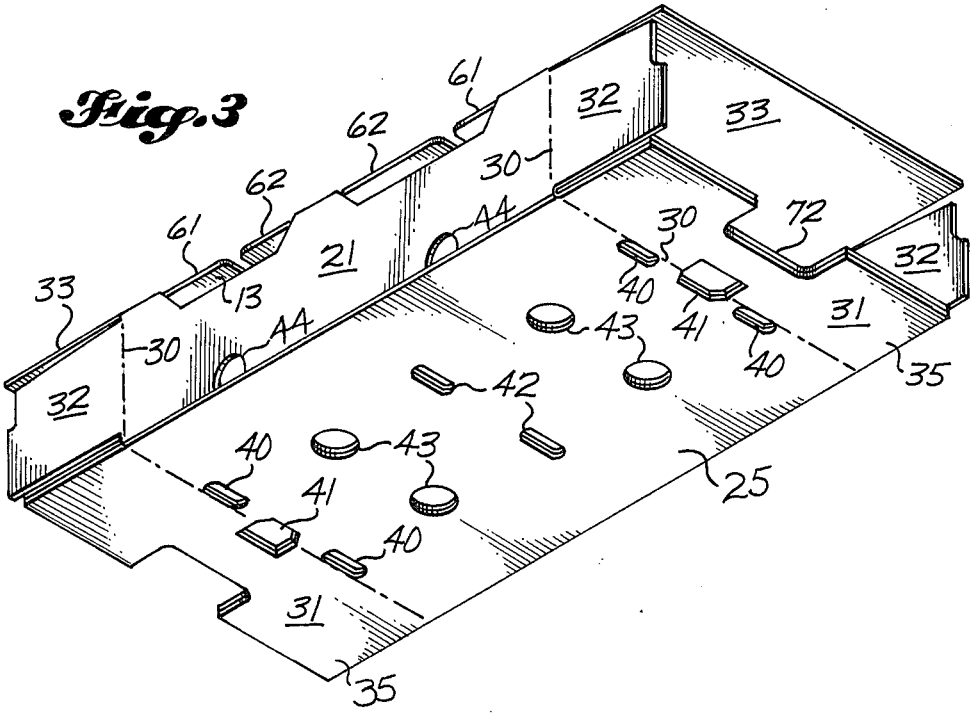
FIG. 3 is an isometric view of the upright tray seen from the bottom.
Figure 4:
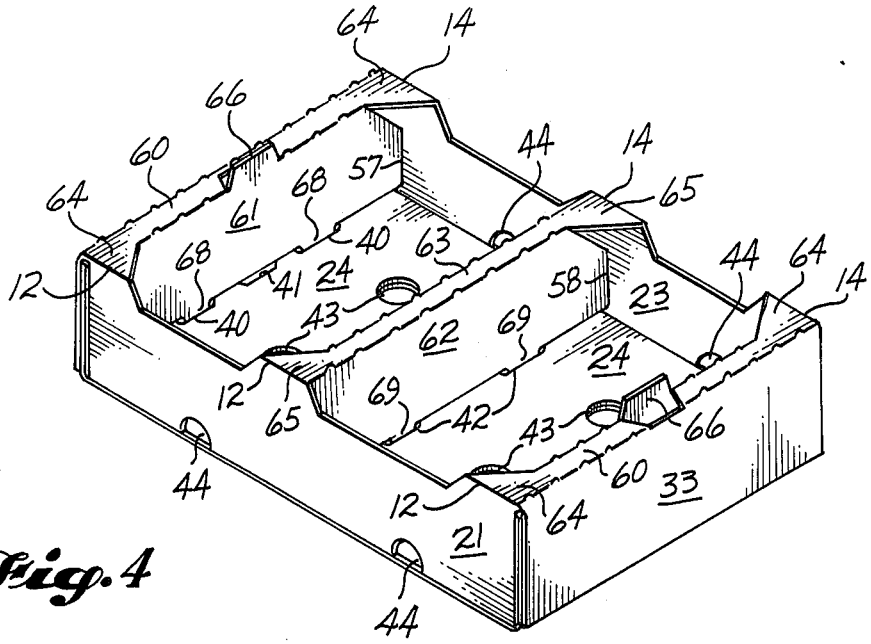
FIG. 4 is an isometric view of the formed tray.
Figure 5:
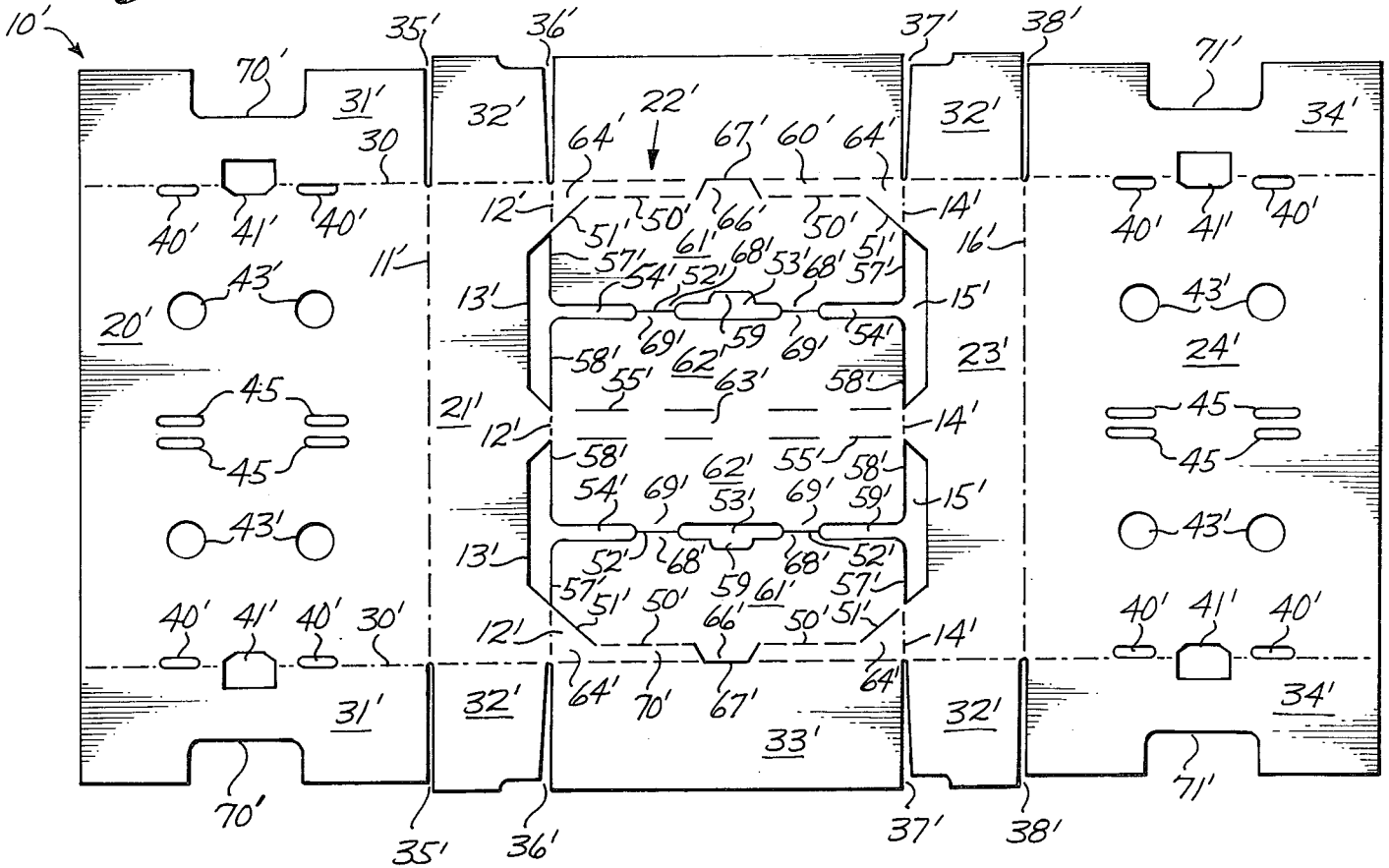
FIG. 5 is a top plan view of a blank for a modified tray.
Figure 6:
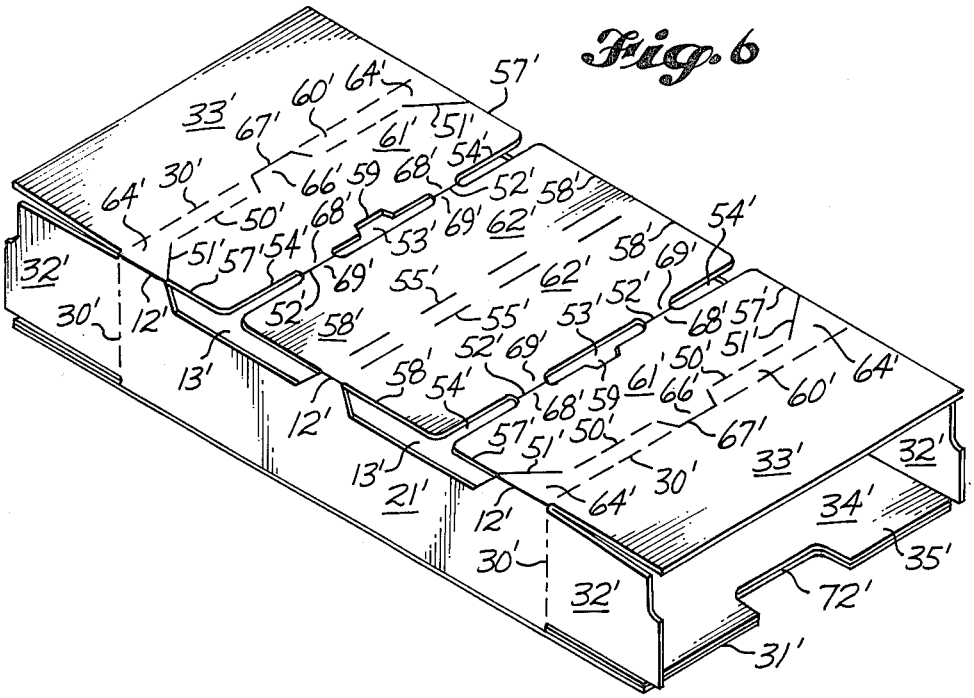
FIG. 6 is an isometric view of the upright modified tray seen from the top.
Figure 7:
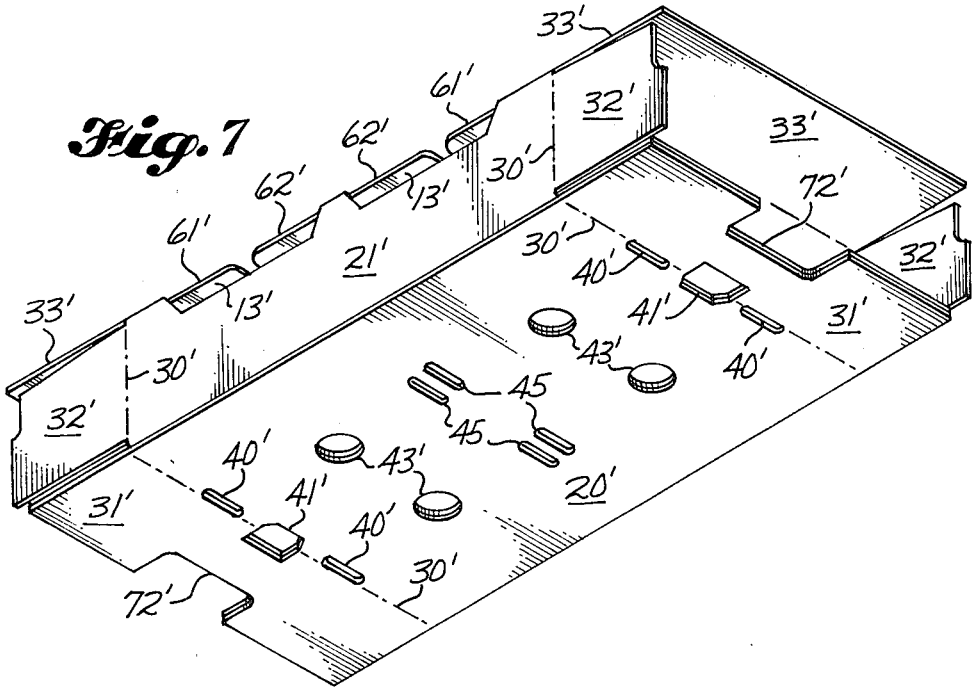
FIG. 7 is an isometric view of the upright modified tray seen from the bottom.
Figure 8:
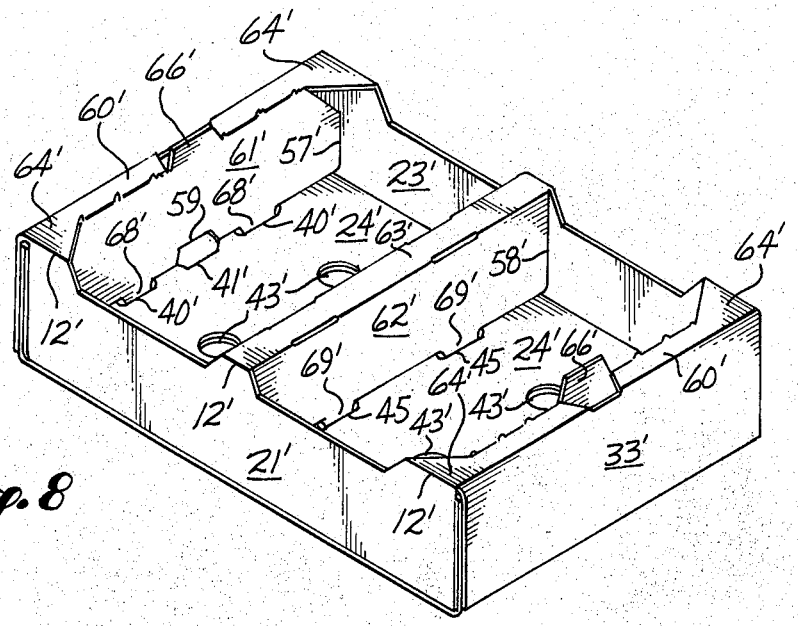
FIG. 8 is an isometric view of the formed modified tray.

The tray is formed by setting it upright as shown in FIG. 2. The side walls 21 and 23 are perpendicular to the two-ply base panel 25 and the upper tray section 22 parallel to the base panel 25. The side end flaps 32 are bent inwardly and the lower two-ply end panels 35 are bent upwardly around score line 30. The upper end panels 33 are bent downwardly and adhered to the lower laminated end panels 35.

The locking panels 61 are bent downwardly around score line 50 and the locking tabs 68 are inserted into locking apertures 40 to hold the panels in place. The locking panels 61 hold the end flaps 32 against the lower end panels 35. The central partitions 62 are bent downwardly around score lines 55 and the locking tabs 69 are inserted into locking apertures 42 to hold the partitions in place.

When the locking panels 61 are locked into place, the stacking tabs 66 extend above the upper panels 60 and 63 of the tray. These stacking tabs will extend through the apertures 41 in the base panel of the next tray above when the trays are stacked. The apertures 41 extend into the end panels 35 to accommodate the stacking tabs 66.

FIGS. 5 through 8 show a modified container. Most of the elements are the same and like reference numerals are used. The principal difference between this tray and the tray shown in FIGS. 1–4 is that the central upper panel 63' is wider requiring separate central locking apertures 45 in place of the single central locking apertures 42. Because of the width of the central upper panel 63', the shoulders 65 and their associated cut lines 56 are eliminated and the score lines 55' extend the entire width of the tray. Another difference is in the locking panel. The central aperture 53' which helps separate the panel 61' and partitions 62' has a relief section 59 extending into the lower edge of locking panel 61'. The relief section 59 is aligned with aperture 41' in the base panel and is part of the relief section in the lower edge of the end panels which accommodates the stacking tab 66'. This relief section 59 can be used in either version of the tray.

The tray is shown with no air holes 44 in the side walls 21' and 23'. This is a modification which will depend upon the product being packed.

These containers have a two-ply base panel and quintuple-ply end panels which reduce bulging of the bottom and provide better stacking strength in the end walls.

I claim:

1. A tray comprising a double-ply base panel formed from first and second base panels which are coextensive, a side panel extending upwardly from each of said first and second base panels, an upper section extending between said side panels and being parallel to said base panel, a double-ply end panel extending upwardly from each end of said double-ply base panel, each of said double-ply end panels being formed from first and second end panels, said first end panels being hingedly attached to said first base panel and said second end panels being hingedly attached to said second base panel, said first and second end panels being coextensive, means holding said end panels in said upright position.

2. The tray of claim 1 in which said means is an upper end panel connected to each end of said upper section, said upper end panel extending downwardly and being joined to one of said double-ply end panels.

3. The tray of claims 1 or 2 further comprising end flaps hingedly attached to the ends of said side panels, said end flaps extending into said container inside the inner face of said double-ply end panels.

4. The tray of claims 1 or 2 further comprising a locking panel hingedly connected to the upper section at each end of said tray, said locking panels being adjacent said end panels, locking tabs on the lower edges of said locking panels, locking apertures in said base panel aligned with said locking tabs, said locking tabs fitting into said locking apertures.

5. The tray of claims 1 or 2 further comprising end clamps hingedly attached to the ends of said side panels, said end clamps extending into the container inside the interface of said double-ply end panels, a locking panel highedly connected to the upper section at each end of said tray, said locking panels being adjacent said end panels, locking tabs on the lower edges of said locking panels, locking apertures in said base panel aligned with said locking tabs, said locking tabs fitting into said locking apertures, said locking panel holding said end clamps against the interface of said double-ply end panels.

6. The tray of claims 1 or 2 further comprising a locking panel hingedly connected to the upper section at each end of said tray, said locking panels being adjacent said end panels, a stocking tab extending upwardly from the upper edge of said locking panel, and a stacking aperture in the base panel aligned with said stacking tab, means that for holding said locking panel in an upright position.

7. The tray of claims 1 or 2 further comprising a locking panel entry connected to the upper section at each end of said tray, said locking panels being adjacent said end panels, a stacking tab extending upwardly from the upper edge of said locking panel, a stocking aperture in the base panel aligned with said stacking tab, said stacking aperture extending into said double-ply end panel, means for holding said locking panel in an upright position.

8. A blank for a tray comprising a first base panel, a first side panel, an upper section, a second side panel and a second base panel connected in sequence by longitudinal score lines, said first base panel and said second base panel being congruent and each being of the same length and width as said upper section, a pair of first end panels connected by a transverse score lines to the ends of said first base panel, a pair of second end panels connected byy transverse score lines to the ends of said second base panels, a pair of upper end panels connected by transverse score lines to the ends of said upper section, end flaps connected by transverse score lines to ends of said first and second side panels, locking panels hingedly connected to said upper section adjacent said end panels and being the same height and width as said end panels.

* * * * *

UNITED STATES PATENT AND TRADEMARK OFFICE

CERTIFICATE OF CORRECTION

PATENT NO. : 4,369,913

DATED : January 25, 1983

INVENTOR(S) : HERBERT D. MUISE

It is certified that error appears in the above—identified patent and that said Letters Patent is hereby corrected as shown below:

IN THE CLAIMS:

Claim 5, line 6, "highedly" should be --hingedly--.

Claim 6, line 5, "stocking" should be --stacking--.

Claim 7, line 7, "stocking" should be --stacking--.

Claim 8, line 10, "byy" should be --by--.

Signed and Sealed this

*Twelfth* Day of *April 1983*

[SEAL]

*Attest:*

GERALD J. MOSSINGHOFF

*Attesting Officer*

*Commissioner of Patents and Trademarks*